US010486333B2

(12) United States Patent
Jeon

(10) Patent No.: US 10,486,333 B2
(45) Date of Patent: Nov. 26, 2019

(54) INGOT PRESSING APPARATUS AND INGOT SLICING APPARATUS INCLUDING THE SAME

(71) Applicant: SK Siltron Co., Ltd., Gumi-si, Gyeongsangbuk-do (KR)

(72) Inventor: Su In Jeon, Gumi-si (KR)

(73) Assignee: SK Siltron Co., Ltd., Gumi-si (KR)

( * ) Notice: Subject to any disclaimer, the term of this patent is extended or adjusted under 35 U.S.C. 154(b) by 214 days.

(21) Appl. No.: 15/645,961

(22) Filed: Jul. 10, 2017

(65) Prior Publication Data

US 2018/0141237 A1 May 24, 2018

(30) Foreign Application Priority Data

Nov. 23, 2016 (KR) ..... 10-2016-0156597

(51) Int. Cl.
*B28D 5/04* (2006.01)
*B28D 5/00* (2006.01)

(52) U.S. Cl.
CPC ..... *B28D 5/045* (2013.01); *B28D 5/0076* (2013.01); *B28D 5/0082* (2013.01)

(58) Field of Classification Search
CPC . B28D 1/048; B28D 1/06; B28D 1/08; B28D 5/0023; B28D 5/0052;
(Continued)

(56) References Cited

U.S. PATENT DOCUMENTS 5,893,308 A * 4/1999 Katamachi ..... B23Q 16/001 125/21
6,119,673 A * 9/2000 Nakaura ..... B28D 5/0082 125/12
(Continued)

FOREIGN PATENT DOCUMENTS

CN 202241654 5/2012
CN 202293068 7/2012
(Continued)

OTHER PUBLICATIONS

Japanese Office Action dated Jul. 12, 2018 issued in Application No. 2017-132439.
(Continued)

*Primary Examiner* — Timothy V Eley
(74) *Attorney, Agent, or Firm* — KED & Associates, LLP

(57) ABSTRACT

A pressing head of the ingot slicing apparatus includes: a head main body in which a plurality of pneumatic supply ports configured to supply compressed air are formed so that pressure on each portion of the pressing head is separately controlled; pressing units installed on a lower end of the head main body, located to correspond to the pneumatic supply ports, and each configured to apply pressure to a side surface of an ingot by the compressed air supplied through each of the pneumatic supply ports; pneumatic correction units each installed on a lower surface of each of the pressing units and configured to control a pressure deviation between the plurality of pressing units; an adhesive plate installed to be in contact with lower side surfaces of the pneumatic correction units so that a lower surface of the adhesive plate is in direct contact with and presses the side surface of the ingot; and a coupling support unit configured to couple and support the head main body, the pressing units, the pneumatic correction units, and the adhesive plate.

20 Claims, 5 Drawing Sheets

(58) Field of Classification Search
CPC .... B28D 5/0076; B28D 5/0082; B28D 5/042; B28D 5/045; B28D 7/04
See application file for complete search history.

(56) References Cited

U.S. PATENT DOCUMENTS

| | | | | |
|---|---|---|---|---|
| 6,773,333 | B2 * | 8/2004 | Lundt | B28D 5/0064 125/16.02 |
| 7,114,424 | B2 * | 10/2006 | Muller | B28D 5/0082 83/459 |
| 9,616,511 | B2 * | 4/2017 | Kim | B23D 57/0046 |
| 2009/0199836 | A1 * | 8/2009 | Gupta | B28D 5/0082 125/20 |
| 2009/0253352 | A1 * | 10/2009 | Oishi | B28D 5/0076 451/7 |
| 2011/0088678 | A1 * | 4/2011 | Kitagawa | B28D 5/0076 125/16.01 |
| 2012/0167733 | A1 * | 7/2012 | Lee | B28D 5/0076 83/169 |
| 2014/0318522 | A1 * | 10/2014 | Tomii | B24B 27/0633 125/16.02 |
| 2018/0085969 | A1 * | 3/2018 | Takahashi | B23D 59/001 |

FOREIGN PATENT DOCUMENTS

| | | |
|---|---|---|
| CN | 202293074 | 7/2012 |
| CN | 202556613 | 11/2012 |
| CN | 204687126 | 10/2015 |
| JP | H11-042548 | 2/1999 |
| JP | H 1199462 | 4/1999 |
| JP | H 11277395 | 10/1999 |
| JP | 2003-001624 | 1/2003 |
| JP | 2005-103683 | 4/2005 |
| JP | 2008-213110 | 9/2008 |
| JP | 2013-086261 | 5/2013 |
| KR | 10-2005-0031752 | 4/2005 |
| KR | 10-0887494 | 3/2009 |
| KR | 10-1506877 | 3/2015 |
| WO | WO 2016/117294 | 7/2016 |

OTHER PUBLICATIONS

Korea Office Action dated Nov. 14, 2017 issued in Application No. 10-2016-0156597.
Chinese Office Action dated Mar. 18, 2019 issued in Application No. 201710757172.7 (English translation attached).
Korean Notice of Allowance dated Mar. 12, 2018 issued in Application No. 10-2016-0156597.

* cited by examiner

INGOT PRESSING APPARATUS AND INGOT SLICING APPARATUS INCLUDING THE SAME

CROSS-REFERENCE TO RELATED APPLICATIONS

This application claims under 35 U.S.C. § 119 to Korean Patent Application No. 10-2016-0156597, filed Nov. 23, 2016, which is hereby incorporated by reference.

BACKGROUND

The embodiment relates to an ingot pressing apparatus and an ingot slicing apparatus including the same.

Generally, in a wafer manufacturing process, a slicing process is performed to slice an ingot grown into a wafer shape during a crystal growth process, and a wire sawing process is a typical slicing process.

Through the wire sawing process, a degree of planarization of a wafer can be improved, and more specifically, a degree of warpage (warping and bowing) of the wafer can be controlled.

The wire sawing process is a process in which an ingot comes into contact with a wire and the ingot is sliced to have a plurality of wafer forms.

A wire sawing apparatus used in the wire sawing process is provided with a plate configured to support an ingot and a roller on which a wire is wound.

Accordingly, in the wire sawing process, an ingot is sliced to have a wafer form by the plate supporting the ingot being relatively moved in a direction of the wire wound on the roller.

During the slicing process of an ingot through wire sawing, a quality of the sliced wafers can be determined by a thermal expansion of the ingot itself, a slurry supplied to the wire during the slicing process, a spindle for rotating the roller which the wire is wound on so that the wire reciprocates, and thermal expansion of the plate holding the ingot.

FIG. 1 is a view illustrating a wire sawing apparatus according to a conventional art, FIG. 2 is a view illustrating an ingot slicing shape according to the conventional art.

A wire sawing apparatus 101 according to the conventional art includes a wire 102 for slicing an ingot, a roller 103 (a wire guide) on which the wire 102 is wound, a tension applying unit 104 for applying tension to the wire 102, an ingot transfer unit 105 which moves the ingot to be sliced, a slurry supply unit 106 which supplies slurry while the ingot is being sliced.

The wire 102 is continuously fed from a wire reel 107, passes through the tension applying unit 104 which includes a powder clutch (a constant torque motor 109), a dancer roller (a dead weight), etc., wherein a traverser 108 is disposed between the wire reel 107 and the tension applying unit 104, and is wound on the roller 103. After the wire 102 is wound on the roller 103 about 300 to 400 times, the wire 102 passes through a tension applying unit 104' and is wound on a wire reel 107'.

Further, the grooved roller 103 is a roller in which a polyurethane resin is applied around a steel cylinder and grooves are formed with a constant pitch on a surface thereof, and the wound wire 102 can be driven in reciprocating directions in a cycle determined by a driving motor 110.

Further, while the ingot is being sliced, the ingot can be moved toward the wire 102 wound on the roller 103 by the ingot transfer unit 105.

Further, a nozzle 115 may be installed near the wire 102 wound on the roller 103 and may supply a slurry from a slurry tank 116 onto the roller 103 and the wire 102 while the ingot is being sliced. Furthermore, a slurry chiller 117 may be connected to the slurry tank 116 so that a temperature of the supplied slurry may be controlled.

By using the wire sawing apparatus 101, suitable tension is applied to the wire 102 using the tension applying unit 104, and the wire 102 is moved in the reciprocating directions to slice the ingot by the driving motor 110.

While the slicing process is being performed, expansion of a frame supporting the ingot, the ingot, and a roller portion occurs due to slicing heat. Since sides of a seed and a tail of the ingot being sliced are deformed due to thermal expansion that occurs at each of the above portions, there are problems in that a degree of planarization of a wafer is lowered and a shape of a sliced surface of the wafer is not uniform.

SUMMARY

The embodiment provides an ingot slicing apparatus including an ingot pressing apparatus capable of controlling thermal expansion that occurs at an ingot being sliced during a wire sawing process.

According to the embodiment, there is provided a pressing head of an ingot slicing apparatus, including: a head main body in which a plurality of pneumatic supply ports configured to supply compressed air are formed so that pressure on each portion of the pressing head is separately controlled; pressing units installed on a lower end of the head main body, located to correspond to the pneumatic supply ports, and each configured to apply pressure to a side surface of an ingot due to the compressed air being supplied through each of the pneumatic supply ports; pneumatic correction units each installed on a lower surface of each of the pressing units and configured to control a pressure deviation between the plurality of pressing units; an adhesive plate installed to be in contact with lower side surfaces of the pneumatic correction units so that a lower surface of the adhesive plate is in direct contact with and presses the side surface of the ingot; and a coupling support unit configured to couple and support the head main body, the pressing units, the pneumatic correction units, and the adhesive plate.

The pressing units may be disposed in a concentric shape from a center of the pressing head in a radial direction, and each of the pneumatic supply ports may be connected to the pressing unit and supply the compressed air thereto.

An upper end of a pressing unit disposed in the center of the pressing head may be provided with a groove in a center thereof through which the compressed air is introduced, and a lower end thereof may be formed to have a wider plate form in a circular shape than the upper end; an upper end portion of each pressing unit around the pressing unit disposed in the center may be provided with an upper surface in which airflow grooves are formed along a circumference thereof so that the compressed air is introduced therethrough, and a lower end thereof may be formed in a wider disk shape than an upper end thereof; and the head main body may be provided with a convexo-concave portion formed in a concentric shape, into which the upper portion end of each of the pressing units is inserted, and the lower ends of the pressing units may be located to be close to each other.

An outer side surface of the upper end of each of the pressing units may be provided with a sealing unit for preventing leakage of the compressed air to prevent the compressed air from leaking through a contact portion between the convexo-concave portion of the head main body and the upper end of the pressing unit.

The sealing unit may include a rubber packing.

The pneumatic correction unit may include a pneumatic balloon pressed against and installed on the lower surface of each of the pressing units and configured to correct the pressure deviation between the pressing units, and an elastic sheet pressed against a lower side surface of the pneumatic balloon and formed of an elastic material.

The pressing head may further include an additional sheet disposed under the elastic sheet and configured to cover the elastic sheet.

An airflow hole may be formed under the airflow groove and the compressed air may be supplied to the pneumatic balloon through the airflow hole.

According to the embodiment, there is provided a pressing head of an ingot slicing apparatus, comprising: a head main body in which a plurality of pneumatic supply ports configured to supply compressed air are formed so that pressure on each portion of the pressing head is separately controlled; pressing units installed on a lower end of the head main body, located to correspond to the pneumatic supply ports, disposed in a concentric shape from a center of the pressing head in a radial direction, connected to the pneumatic supply ports, and each configured to apply pressure to a side surface of an ingot; pneumatic correction units each installed on a lower surface of each of the pressing units and configured to control a pressure deviation between the plurality of pressing units; an adhesive plate installed to be in contact with lower side surfaces of the pneumatic correction units so that a lower surfaces of the adhesive plate is in direct contact with and presses the side surface of the ingot; and a coupling support unit configured to couple and support the head main body, the pressing units, the pneumatic correction units, and the adhesive plate. The pressing unit may include a plurality of pressing blocks; and the pressing blocks may apply different pressures to different regions of the side surface of the ingot.

An upper end of a pressing unit disposed in the center of the pressing head may be provided with a groove in a center thereof through which the compressed air is introduced, and a lower end thereof may be formed to have a wider plate form in a circular shape than the upper end; an upper end portion of each pressing unit around the pressing unit disposed in the center may be provided with an upper surface in which airflow grooves are formed along a circumference thereof so that the compressed air is introduced therethrough, and a lower end thereof may be formed in a wider disk shape than an upper end thereof; and the head main body may be provided with a convexo-concave portion formed in a concentric shape, into which the upper end portion of each of the pressing units is inserted, and the lower ends of the pressing units may be located to be close to each other.

An outer side surface of the upper end of each of the pressing units may be provided with a sealing unit for preventing leakage of the compressed air to prevent the compressed air from leaking through a contact portion between the convexo-concave portion of the head main body and the upper end of the pressing unit.

The sealing unit may include a rubber packing.

The pneumatic correction unit may include a pneumatic balloon pressed against and installed on the lower surface of the pressing unit and configured to correct the pressure deviation between the pressing units, and an elastic sheet pressed against a lower side surface of the pneumatic balloon and formed of an elastic material.

The pressing head may further include an additional sheet disposed under the elastic sheet and configured to cover the elastic sheet.

An airflow hole may be formed under the airflow groove and the compressed air may be supplied to the pneumatic balloon through the airflow hole.

According to the embodiment, there is provided an ingot slicing apparatus including a wire configured to slice an ingot, a roller configured to support the wire, and a roller support portion, the ingot slicing apparatus comprising: a beam including a lower surface attached to the ingot and provided with a cooling bar insertion groove inside a body thereof; a work plate attached to an upper surface of the beam and configured to vertically move the ingot; and a pressing head disposed on a portion of a side surface of the ingot to be sliced.

The pressing head may control thermal expansion of the ingot that occurs during a process of slicing the ingot.

The pressing head may include a pressure transfer portion on the portion of the side surface, and the pressure transfer portion is coupled to a body portion of the ingot slicing apparatus.

The pressing head may include: a head main body in which a plurality of pneumatic supply ports configured to supply compressed air are formed so that pressure on each portion of the pressing head is separately controlled; pressing units installed on a lower end of the head main body, located to correspond to the pneumatic supply ports, and configured to apply pressure to the side surface of the ingot due to the compressed air being supplied through each of the pneumatic supply ports; pneumatic correction units each installed on a lower surface of each of the pressing units and configured to control a pressure deviation between the plurality of pressing units; an adhesive plate installed to be in contact with lower side surfaces of the pneumatic correction units so that a lower surfaces of the adhesive plate is in direct contact with and presses the side surface of the ingot; and a coupling support unit configured to couple and support the head main body, the pressing units, the pneumatic correction units, and the adhesive plate.

DETAILED DESCRIPTION OF THE EMBODIMENTS

Hereinafter, embodiments of the present invention will be described in detail with reference to the accompanying drawings. However, the scope of the embodiments of the present invention may be determined from the matters disclosed in the present embodiment, and it should be understood that the spirit of the embodiments of the present invention includes practical variations such as addition, deletion, modification, and the like of components included in the proposed embodiments herein.

Figure 1:
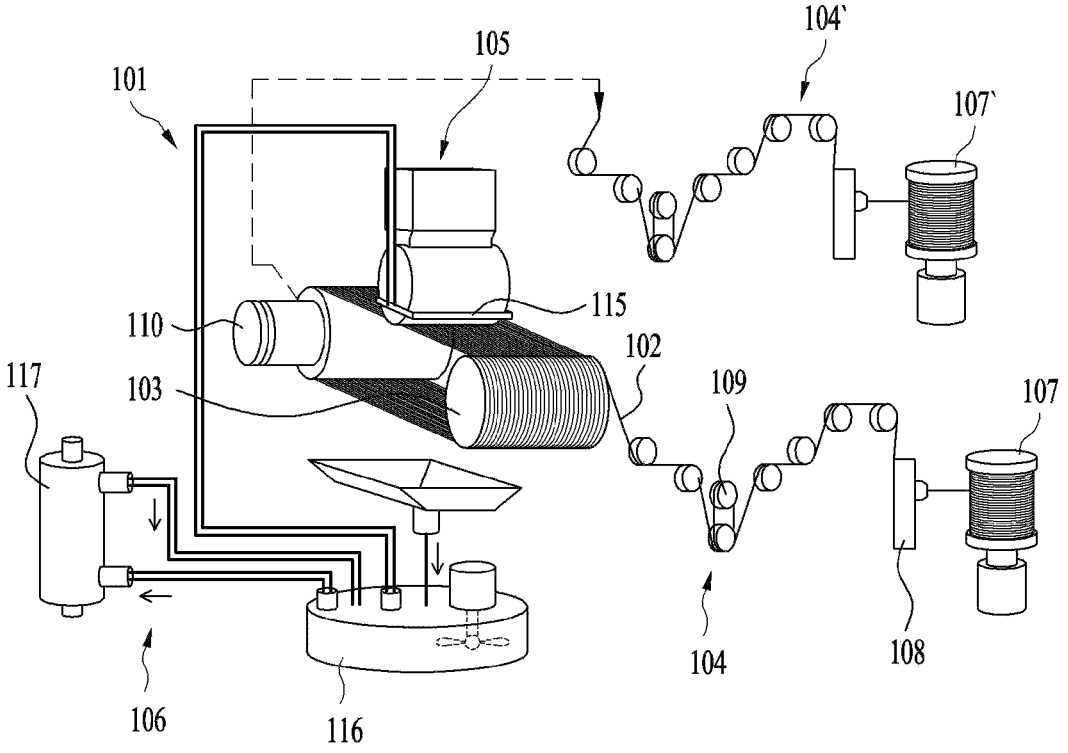
FIG 1 PRIOR ART
FIG. 1 is a view illustrating a processing state of an ingot slicing apparatus according to a conventional art.
Figure 2:
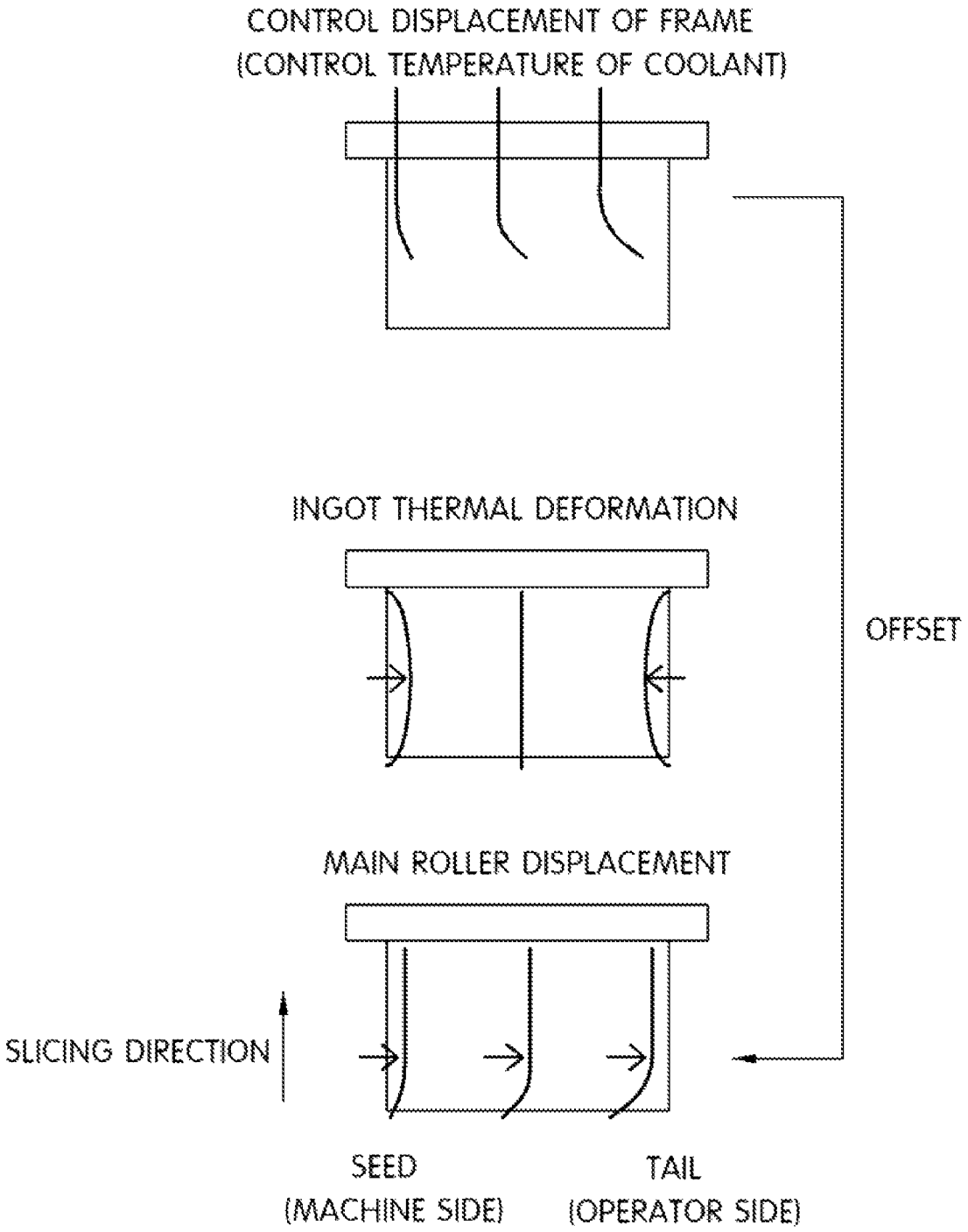
FIG 2 PRIOR ART
FIG. 2 is a graph illustrating a direction of wafer warpage when an ingot is sliced according to the conventional art.
Figure 3:
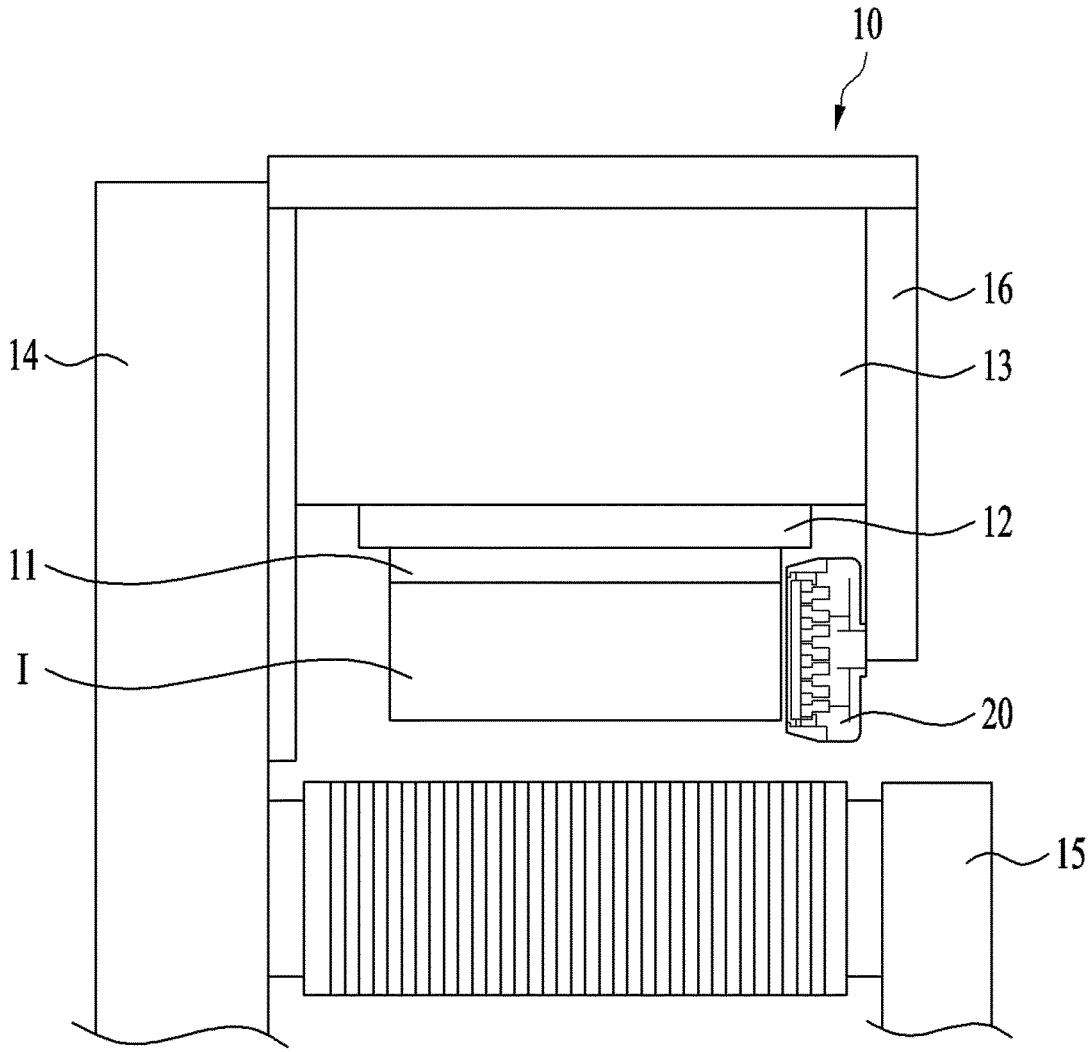
FIG. 3 is a cross-sectional view illustrating an ingot slicing apparatus according to an embodiment of the present invention.

FIG. 3 is a cross-sectional view illustrating an ingot slicing apparatus according to an embodiment of the present invention.

As shown in FIG. 3, an ingot slicing apparatus 10 according to the embodiment of the present invention may include a beam 11, a work plate 12, a table 13, a body portion 14, a roller portion 15, a pressing head 20, and a pressure transfer portion 16. An ingot I may be attached to a lower surface of the beam 11, and a cooling bar insertion groove may be formed inside a body of the beam 11.

The work plate 12 may be attached to an upper surface of the beam 11, may support the beam 11, to which the ingot I is attached, from above the beam 11, and may vertically move the ingot I.

The table 13 may vertically move the ingot I and the work plate 12, and the body portion 14 may support the table 13 from one side surface of the table 13.

The roller portion 15 may include a roller, and a wire may be wound on the roller.

The pressing head 20 may be disposed at a side surface of the ingot I to be sliced, and the pressure transfer portion 16 may apply pressure to the pressing head 20.

The pressing head 20 that applies pressure to the side surface of the ingot may include a head main body 21, pressing units 25, 27, and 29, a pneumatic correction unit, an adhesive plate 23, and a coupling support unit.

Figure 4:
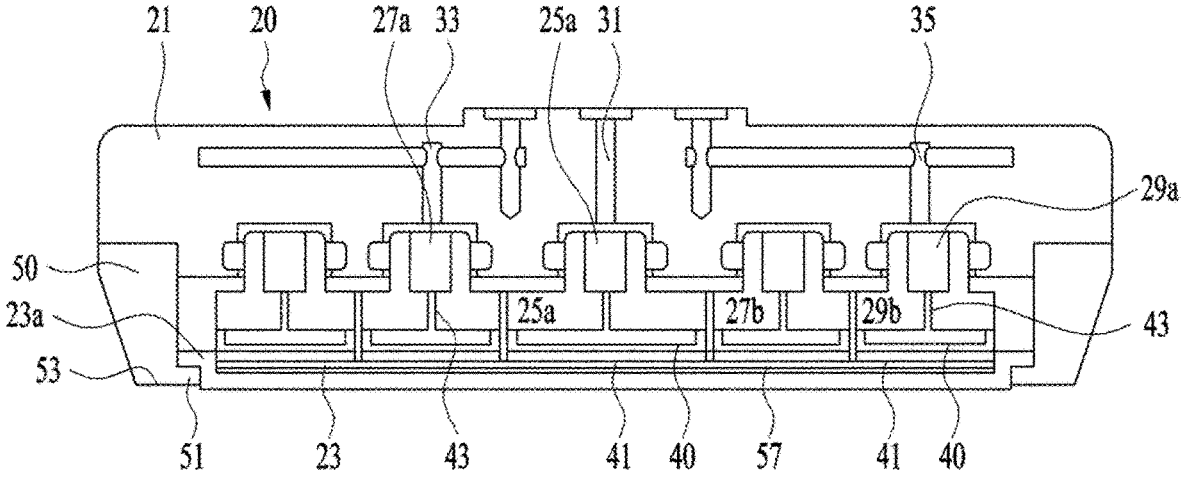
FIG. 4 is a cross-sectional view illustrating a pressing head according to the embodiment of the present invention.
Figure 5:
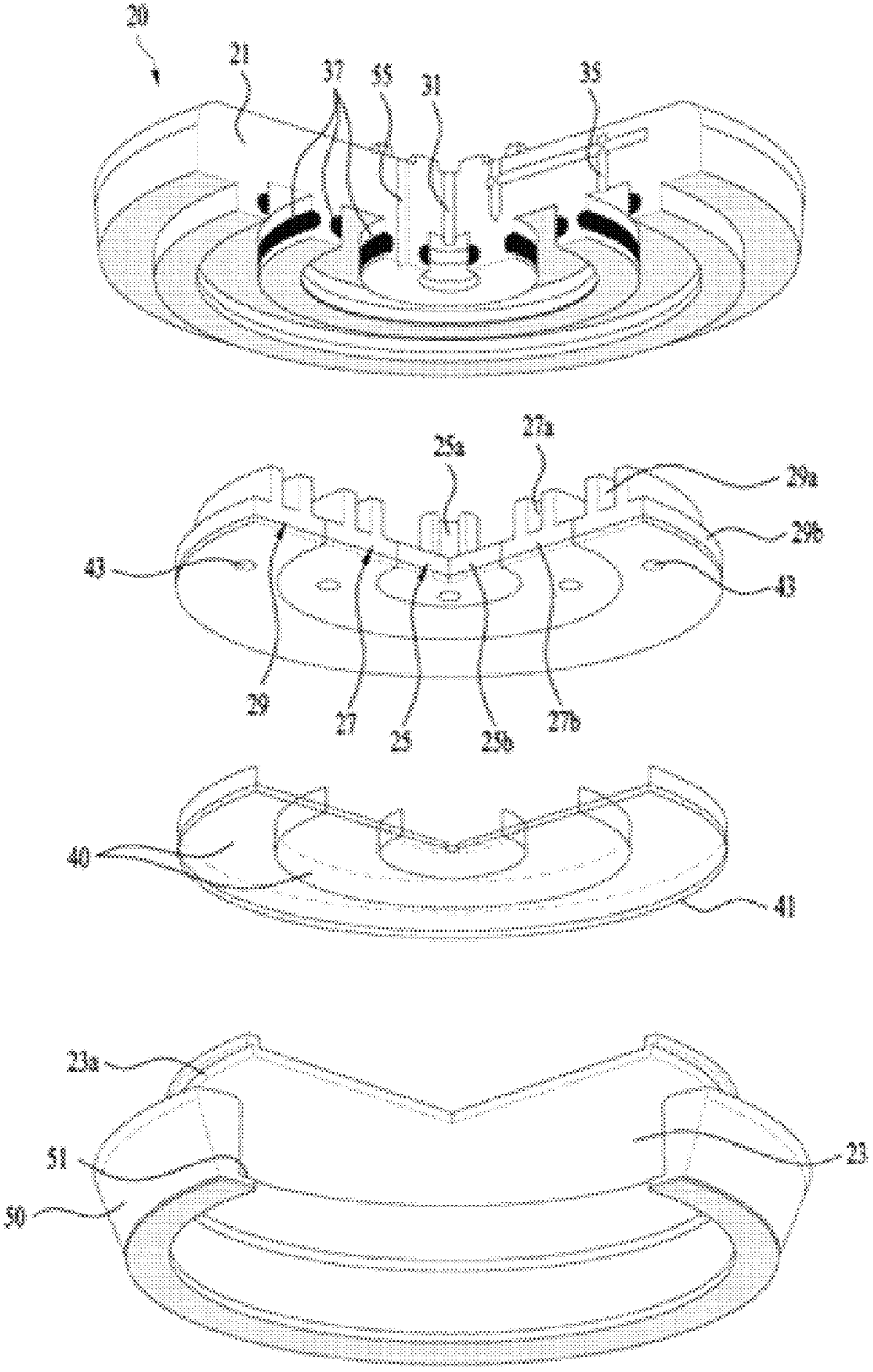
FIG. 5 is an exploded perspective view illustrating the pressing head according to the embodiment of the present invention.

FIG. 4 is a cross-sectional view illustrating a pressing head according to the embodiment of the present invention, and FIG. 5 is an exploded perspective view illustrating the pressing head according to the embodiment of the present invention.

As shown in FIGS. 4 and 5, the pressing head according to the embodiment of the present invention may apply pressure to a side surface of an ingot and may control the pressure being applied to each portion of the side surface of the ingot.

In the pressing head 20 according to the embodiment of the present invention, the pressing head 20 may be divided into a plurality of portions, and pressure of each of the portions can be separately controlled.

The entire pressing head 20 according to the embodiment of the present invention may have a thick disk shape, and may include an upper half of the head main body 21 and a pressing unit connected to the upper half and configured to press the ingot. Further, a lower side surface of the pressing head 20 may be provided with an adhesive plate 23 attached to the side surface of the ingot.

Since the pressing head 20 according to the embodiment of the present invention has to control the pressure for each of the portions, the pressing head 20 may be provided with the plurality of pressing blocks 25, 27, and 29 as pressing units, and pneumatic supply ports 31, 33, and 35, which serve as a pneumatic supply units for supplying compressed air to each of the pressing blocks 25, 27, and 29, may be installed inside the head main body 21.

The pneumatic supply ports 31, 33, and 35 according to the embodiment of the present invention may be provided with a separate pressure control unit so that measurement and control of a pressing force are separately performed on each of the pressing blocks 25, 27, and 29.

The pressing unit according to the embodiment of the present invention may include three pressing blocks 25, 27, and 29 which are formed in a concentric shape from a center of the pressing head 20 in a radial direction, but the number of the pressing units is not limited thereto in the embodiment.

A tube type groove 25*a* may be formed above a first pressing block 25 located at the center of the pressing head 20 and may be in a cylindrical shape so that compressed air from a pneumatic supply port 31 is accommodated therein. Further, a pressing plate 25*b* at a lower end portion of the pressing head 20 may be in a wider disk shape than an upper end portion to evenly press a wide area.

Upper surfaces of a second pressing block 27, which surrounds an outer side of the first pressing block 25 in the radial direction, and an upper end of a third pressing block 29, which surrounds the second pressing block 27, in a concentric shape are provided with airflow grooves 27*a* and 29*a* in a circumferential direction of each of the pressing blocks to accommodate compressed air from the pneumatic supply ports 31, 33, and 35, and thus air paths may be formed.

Further, upper end portions of the second and third pressing blocks 27 and 29 have cross sections formed in a cylindrical shape, and the pressing plates 27*b* and 29*b* at the lower end portion may be in a wide concentric plate shape.

In the embodiment of the present invention, since the plurality of pressing plates 25*b*, 27*b*, and 29*b* of the pressing blocks are located to be close to each other, a deviation of pressure being applied to the side surface of the ingot, which occurs due to gaps being present between the pressing blocks 25, 27, and 29, can be prevented.

Further, a lower end portion of the head main body 21 may be provided with a convexo-concave portion formed in a concentric shape, into which upper end potions of the first, second, and third pressing blocks 25, 27, and 29 may be inserted.

In order to prevent the compressed air from leaking through contact portions between the head main body 21 and the pressing blocks 25, 27, and 29, sealing units 37 may be disposed between both side surfaces of the upper end portions of the first, second, and third pressing blocks 25, 27, and 29 and the head main body 21 to prevent leakage of the compressed air introduced from the pneumatic supply ports 31, 33, and 35.

In the embodiment of the present invention, ring shaped sealing units, such as O-rings or quad rings, which are formed of a rubber material and serve as the sealing units 37, may be installed to be pressurized along a circumferential surface at which upper ends of the pressing blocks 25, 27, and 29 are in contact with the head main body 21.

Meanwhile, a lower surface of each of the pressing plates 25*b*, 27*b*, and 29*b* is provided with a pneumatic correction unit which reduces a deviation of pressure that is applied to the pressing blocks 25, 27, and 29, and the pneumatic correction unit according to the embodiment of the present invention may include a pneumatic balloon 40 attached to a lower surface of the pressing block and an elastic sheet 41 installed to be pressed against a lower surface of the pneumatic balloon 40.

The pneumatic balloon 40 according to the embodiment of the present invention is inflated by the compressed air, and presses and corrects the lower end portion of the adhesive plate 23 to linearly change a pressure difference at boundaries of the pressing blocks 25, 27, and 29. To this end, an airflow hole 43 is formed to communicate with the pneumatic balloon 40 in a lower direction from each of the airflow grooves 25*a*, 27*a*, and 29*a* of the pressing blocks 25, 27, and 29, and thus a structure used for inflating the pneumatic balloon 40 using some of air that presses the pressing blocks 25, 27, and 29 may be formed.

The elastic sheet 41 according to the embodiment of the present invention may be installed to be pressed against the lower surface of the pneumatic balloon, may have a material capable of maintaining a predetermined strength which maintains the pressure applied to the pressing blocks 25, 27, and 29, and may be formed of a material having an elastic force to correct a pressure difference between blocks. Accordingly, the elastic sheet 41 according to the embodiment of the present invention may be formed of a resin material which is an elastic material.

Further, an additional sheet 57 configured to cover the elastic sheet 41 may further be provided under the elastic sheet 41 according to the embodiment.

The deviation of pressure applied to the above-described pressing units may be uniform at a surface of the additional sheet 57.

The adhesive plate 23, which is a planar plate installed on a lower surface of the pressing head 20 and attached to a wafer, may be formed with a metallic disk having a predetermined thickness that may maintain a high degree of planarization and be linearly changed as desired.

In the embodiment of the present invention, the pressing unit, the pneumatic correction unit, and the coupling support unit configured to couple and support the adhesive plate 23 and the head main body 21 may be provided. The coupling support unit according to the embodiment of the present invention may be provided with a cylindrical shaped frame 50 which supports outer sides of the pressing unit and the pneumatic correction unit and has a stepped portion 51 formed on an inner circumferential surface thereof so that the adhesive plate 23 is mounted thereon, but the shape of the coupling support unit is not limited thereto.

Further, a stepped flange 23*a* may be formed at an edge portion of the adhesive plate 23 according to the embodiment of the present invention so that the adhesive plate 23 may be mounted on the stepped portion 51 of the cylindrical shaped frame 50. When the adhesive plate 23 is mounted on the cylindrical shaped frame 50, a lower surface of the adhesive plate 23 and a lower surface of the cylindrical shaped frame 50 may be coplanar.

Further, a structure in which compressed air may be directly supplied to the adhesive plate 23 and air may be purged by a pressure of the compressed air may be formed to prevent a polishing liquid or a pollutant from passing through the edge portion of the adhesive plate 23 in the embodiment of the present invention. To this end, a separate pneumatic supply port 55 may be formed in the head main body 21 according to the embodiment of the present invention so that the compressed air may directly reach the adhesive plate 23.

Actions of the pressing head of the ingot slicing apparatus according to the embodiment of the present invention having the above described configuration will be described below.

When an ingot is sliced using a wire sawing apparatus provided with the pressing head 20 having the above configuration, the ingot is moved in a wire direction and is sliced into wafer forms while a side surface of the ingot is pressed against the adhesive plate 23.

In this case, during the above ingot slicing process, pneumatic supply ports may supply various different states of compressed air to the pressing blocks 25, 27, and 29, which are pressing units, through separate control units, the pressing blocks 25, 27, and 29 may press the adhesive plate 23 due to pressure of the various states of the supplied compressed air, and thus the side surface of the ingot may be pressurized.

Particularly, the compressed air supplied to the pressing blocks 25, 27, and 29 may be separately controlled according to a slicing depth of the ingot being sliced. A pressure of the third pressing block 29 corresponding to a lower end portion of the ingot is decreased in an initial stage of the ingot slicing process, a pressure of the second pressing block 27 is decreased in a middle stage of the ingot slicing process, and a pressure of the first pressing block 25 is decreased in a final stage of the ingot slicing process so that pressure being applied to the pressing head is removed, and thus broken areas of a wafer can be minimized and pressure on an expansion unit can be controlled.

Further, pneumatic balloons are inflated by compressed air that passes through airflow holes, and an adhesive plate located thereunder may be pressurized. Even when a pneumatic difference between the pneumatic balloons is present, the elastic sheet 41 provided on a lower surface of the pneumatic balloon 40 may correct a step difference, and the elastic sheet 41 may correct a pressure difference at a boundary between each of the pressing blocks 25, 27, and 29 and each of the pneumatic balloons and may control the correction results to be linearly changed.

Further, a thin film (not shown) may be additionally installed on a lower end of the elastic sheet 41, and the thin film corrects differences between pressures at the boundaries to be more linearly changed.

Since a pressing force on each pressing unit is individually controlled during the entire ingot slicing process, a degree of pressure on each portion of the side surface of the ingot can vary or wafers having a high degree of planarization can be manufactured during the ingot slicing process according to the user's intention.

Further, since compressed air is directly supplied to the adhesive plate 23 through the pneumatic supply ports 55, a polishing liquid can be prevented from flowing into the pressing head 20 through an edge of the adhesive plate 23 due to a spraying pressure of the compressed air.

According to the present invention, pressure that is applied to each portion of a side surface of an ingot can be controlled during an ingot slicing process using the above-described configuration.

Accordingly, by providing an ingot pressing apparatus and a pressing head, a degree of warpage (warping and bowing) of an ingot being sliced can be prevented from being lowered during a wire sawing process, and a shape of a sliced surface can be controlled.

Further, a surface of a wafer being sliced can be highly planarized.

It should be obvious that the scope of the present invention is not limited to the above embodiments, but is defined by the matters defined in the claims of the present invention, and includes various modifications and adaptations by those skilled in the art within the scope of equivalence of the claims.

What is claimed is:

1. A pressing head of an ingot slicing apparatus, the pressing head separated into a plurality of portions, the pressing head comprising:

a head main body in which a plurality of pneumatic supply ports configured to supply compressed air are formed so that pressure on each of the portions of the pressing head are separately controlled;

a plurality of pressing units installed on a lower end of the head main body, each of the pressing units located to correspond to a separate one of the pneumatic supply ports, and each of the pressing units is configured to apply pressure to a side surface of an ingot by the compressed air separately supplied through the corresponding one of the pneumatic supply ports;

pneumatic correction units each separately installed on a lower surface of one of the pressing units and the pneumatic correction units configured to control pressure deviation among different ones of the plurality of pressing units;

an adhesive plate installed to be in contact with lower side surfaces of the pneumatic correction units so that a lower surface of the adhesive plate is in direct contact with and presses the side surface of the ingot when the ingot is present; and a coupling support unit configured to couple and support the head main body, the pressing units, the pneumatic correction units, and the adhesive plate.

2. The pressing head of claim 1, wherein:

the pressing units are disposed in a concentric shape from a center of the pressing head in a radial direction; and each of the pneumatic supply ports is separately connected to a corresponding one of the pressing units and separately supplies the compressed air.

3. The pressing head of claim 2, wherein:

an upper end of a specific one of the pressing units disposed flat the center of the pressing head is provided with a groove in the center of the pressing head, through which the compressed air is introduced, and a lower end of the specific one of the pressing units is formed to have a wider plate form in a circular shape than the upper end of the specific one of the pressing units;

an upper end portion of each of the pressing units around the specific one of the pressing units is provided with an upper surface in which airflow grooves are formed along a circumference thereof so that the compressed air is introduced therethrough, and a lower end of each of the pressing units is formed in a wider disk shape than an upper end of the corresponding one of the pressing units; and the head main body is provided with a convexo-concave portion formed in a concentric shape, into which the upper end portion of each of the pressing units is inserted.

4. The pressing head of claim 3, wherein an outer side surface of the upper end of each of the pressing units is provided with a sealing unit for preventing a leakage of the compressed air and prevents the compressed air from leaking through a contact portion between the convexo-concave portion of the head main body and the upper end of the pressing units.

5. The pressing head of claim 4, wherein each of the sealing units includes a rubber packing.

6. The pressing head of claim 3, wherein the pneumatic correction unit includes:

a pneumatic balloon pressed against and installed on the lower surface of each of the pressing units and configured to correct the pressure deviation among the different ones of the pressing units; and an elastic sheet pressed against a lower side surface of the pneumatic balloon and formed of an elastic material.

7. The pressing head of claim 6, further comprising an additional sheet disposed under the elastic sheet and configured to cover the elastic sheet.

8. The pressing head of claim 6, wherein an airflow hole is separately formed under each of the airflow grooves and the compressed air is supplied to the pneumatic balloon through the respective airflow hole.

9. A pressing head of an ingot slicing apparatus, the pressing head separated into a plurality of portions, the pressing head comprising:

a head main body in which a plurality of pneumatic supply ports configured to supply compressed air are formed so that pressure on each of the portions of the pressing head are separately controlled;

a plurality of pressing units installed on a lower end of the head main body, each of the pressing units located to correspond to a separate one of the pneumatic supply ports, disposed in a concentric shape from a center of the pressing head in a radial direction, connected to the pneumatic supply ports, and each of the pressing units configured to apply pressure to a side surface of an ingot;

pneumatic correction units each separately installed on a lower surface of one of the pressing units and the pneumatic correction units configured to control pressure deviation among different ones of the plurality of pressing units;

an adhesive plate installed to be in contact with lower side surfaces of the pneumatic correction units so that a lower surface of the adhesive plate is in direct contact with and presses the side surface of the ingot when the ingot is present; and a coupling support unit configured to couple and support the head main body, the pressing units, the pneumatic correction units, and the adhesive plate.

10. The pressing head of claim 9, wherein:

the plurality of pressing units includes a plurality of pressing blocks; and the pressing blocks apply different pressures to regions of the side surface of the ingot, wherein the regions are different from each other.

11. The pressing head of claim 9, wherein:

an upper end of a specific one of the pressing units disposed at the center of the pressing head is provided with a groove in the center of the pressing head, through which the compressed air is introduced, and a lower end of the specific one of the pressing units is formed to have a wider plate form in a circular shape than the upper end of the specific one of the pressing units;

an upper end portion of each of the pressing units around the specific one of the pressing units is provided with an upper surface, in which airflow grooves are formed along a circumference thereof so that the compressed air is introduced therethrough, and a lower end of each of the pressing units is formed in a wider disk shape than an upper end of the corresponding one of the pressing units; and the head main body is provided with a convexo-concave portion formed in a concentric shape, into which the upper end portion of each of the pressing units is inserted.

12. The pressing head of claim 11, wherein an outer side surface of the upper end of each of the pressing units is provided with a sealing unit for preventing a leakage of the compressed air and prevents the compressed air from leaking through a contact portion between the convexo-concave portion of the head main body and the upper end of the pressing units.

13. The pressing head of claim 12, wherein each of the sealing units includes a rubber packing.

14. The pressing head of claim 11, wherein the pneumatic correction unit includes:

a pneumatic balloon pressed against and installed on the lower surface of the pressing unit and configured to correct the pressure deviation among different ones of the pressing units; and an elastic sheet pressed against a lower side surface of the pneumatic balloon and formed of an elastic material.

15. The pressing head of claim 14, further comprising an additional sheet disposed under the elastic sheet and configured to cover the elastic sheet.

16. The pressing head of claim 14, wherein an airflow hole is separately formed under each of the airflow grooves and the compressed air is supplied to the pneumatic balloon through the respective airflow hole.

17. An ingot slicing apparatus comprising a wire configured to slice an ingot, a roller configured to support the wire, and a roller support portion, the ingot slicing apparatus comprising:

a beam having a lower surface to which the ingot is attached and provided with a cooling bar insertion groove inside a body of the beam;

a work plate attached to an upper surface of the beam and configured to vertically move the ingot; and a pressing head disposed on a portion of a side surface of the ingot.

18. The ingot slicing apparatus of claim 17, wherein the pressing head controls thermal expansion of the ingot, which occurs during a process of slicing the ingot.

19. The ingot slicing apparatus of claim 17, wherein the pressing head includes a pressure transfer portion formed on a side surface of the pressing head, and the pressure transfer portion is coupled to a body portion of the ingot slicing apparatus.

20. The ingot slicing apparatus of claim 17, wherein the pressing head separated into a plurality of portions, wherein the pressing head includes:

a head main body in which a plurality of pneumatic supply ports configured to supply compressed air are formed so that pressure on each of the portions of the pressing head are separately controlled;

a plurality of pressing units installed on a lower end of the head main body, each of the pressing units located to correspond to a separate one of the pneumatic supply ports, and the plurality of pressing units are configured to apply pressure to the side surface of the ingot by the compressed air supplied through different ones of the pneumatic supply ports;

pneumatic correction units each separately installed on a lower surface of one of the pressing units and the pneumatic correction units configured to control pressure deviation among different ones of the plurality of pressing units;

an adhesive plate installed to be in contact with lower side surfaces of the pneumatic correction units so that a lower surface of the adhesive plate is in direct contact with and presses the side surface of the ingot when the ingot is present; and a coupling support unit configured to couple and support the head main body, the pressing units, the pneumatic correction units, and the adhesive plate.

* * * * *